US007464679B2

(12) United States Patent
Sailer et al.

(10) Patent No.: US 7,464,679 B2
(45) Date of Patent: Dec. 16, 2008

(54) HYDRAULIC LASH ADJUSTER

(75) Inventors: Peter Sailer, Erlangen (DE); Oliver Schnell, Veitsbronn (DE)

(73) Assignee: INA Schaeffler KG, Herzzogenaurach (DE)

( * ) Notice: Subject to any disclaimer, the term of this patent is extended or adjusted under 35 U.S.C. 154(b) by 545 days.

(21) Appl. No.: 11/063,444

(22) Filed: Feb. 23, 2005

(65) Prior Publication Data

US 2006/0081206 A1 Apr. 20, 2006

Related U.S. Application Data

(60) Provisional application No. 60/618,810, filed on Oct. 14, 2004.

(51) Int. Cl.
*F01L 1/14* (2006.01)

(52) U.S. Cl. ..... 123/90.55; 123/90.55; 123/90.48

(58) Field of Classification Search ..... 123/90.55, 123/90.52, 90.48, 90.45, 90.46
See application file for complete search history.

(56) References Cited

U.S. PATENT DOCUMENTS 2,874,685 A * 2/1959 Line ..... 123/90.55
4,706,971 A * 11/1987 Schirmer ..... 277/548
6,439,186 B1 * 8/2002 Owen et al. ..... 123/90.55
2004/0211380 A1 * 10/2004 Maeno et al. ..... 123/90.52

* cited by examiner

*Primary Examiner*—Zelalem Eshete
(74) *Attorney, Agent, or Firm*—Charles A. Muserlian

(57) ABSTRACT

What is proposed is a hydraulic lash adjuster (1), for example for a valve train of an internal combustion engine. The lash adjuster (1) comprises a hollow cylindrical housing (2) that is inter-inserted with an axially relatively displaceable pressure piston (3). A high pressure chamber (6) for hydraulic medium extends between opposing front ends (4, 5) of the pressure piston (3) and the housing (2). The high pressure chamber (6) can be supplied, via a one-way valve (8) arranged on the front end (4) and opening towards the high pressure chamber (6) with hydraulic medium out of a reservoir (9). A leak gap (12) for the hydraulic medium is formed between an outer peripheral surface (10) of the pressure piston (3) and a bore (11) of the housing (2). In its portion adjoining the front end (5) of the housing (2), the bore (11) of the housing (2) merges into an annular enlargement (15). According to the invention, the front end (4) of the pressure piston (3) comprises in its transition region to the outer peripheral surface (10), a chamfer (16) whose height ($H_F$) is equal to or larger than a height ($H_R$) of the annular enlargement (15). In this way, it is effectively prevented that undesired particles situated in the high pressure chamber (6) get deposited on the outer peripheral surface (10) of the pressure piston (3) in the sunk state thereof, and penetrate into the leak gap (12) during the subsequent adjusting operation with the danger of a clamping of the pressure piston (3).

3 Claims, 1 Drawing Sheet

HYDRAULIC LASH ADJUSTER

PRIOR APPLICATION

This application is a non-provisional application of provisional application Ser. No. 60/618,810 filed Oct. 14, 2004.

FIELD OF THE INVENTION

The invention concerns a hydraulic lash adjuster comprising a hollow cylindrical housing that is inter-inserted with an axially relatively displaceable pressure piston, wherein a high pressure chamber for hydraulic medium extends between opposing front ends of the pressure piston and the housing, which high pressure chamber can be supplied, via a one-way valve arranged on an undersurface of the front end of the pressure piston and opening towards the high pressure chamber, with hydraulic medium out of a reservoir enclosed by the pressure piston, a leak gap for the hydraulic medium out of the high pressure chamber is formed between an outer peripheral surface of the pressure piston and a bore of the housing, the front end of the housing forms a stop surface for an annular portion of the front end of the pressure piston in a sunk state of the pressure piston, and, in a portion adjoining the front end of the housing, the bore of the housing merges into an annular enlargement.

BACKGROUND OF THE INVENTION

A lash adjuster of the pre-cited type is disclosed in DE 199 42 983 A1. This lash adjuster is configured as a hydraulic support element for a finger lever of a valve train of an internal combustion engine. If the cam acting on the finger lever is in a lift phase when the internal combustion engine is shut off, the pressure piston sinks onto the opposing front end of the housing.

As is unnecessary to explain to a person skilled in the art, undesired particles can accumulate in the high pressure chamber. These consist, for example, of fabrication-related primary dirt or particles such as scuffing chips transported by the hydraulic medium. These particles form an adhesive deposit on the outer peripheral surface of the pressure piston and, at the next lash adjustment when the pressure piston executes an outward axial movement out of the bore of the housing, they can penetrate into a leak gap between the outer peripheral surface of the pressure piston and the bore of the housing. This can lead to a clamping of the pressure piston in the bore of the housing with the consequence that a lash adjusting function of the lash adjuster is no longer possible, or a proper valve lift can no longer be executed. The tendency of the undesired particles to form a deposit is promoted by the fact that a relatively small volume is available on the outer peripheral surface of the sunk pressure piston in the radial direction towards the annular enlargement (undercut).

Efforts have also been made in the prior art to solve the aforesaid problem with the primary dirt by using very complex rinsing measures. It is also known to prevent the ingress of undesired particles into the high pressure chamber using separators such as screens, magnets etc. arranged immediately upstream of the actual lash adjuster.

OBJECTS OF THE INVENTION

It is an object of the invention to provide a lash adjuster of the pre-cited type in which the aforesaid drawbacks are eliminated.

This and other objects and advantages of the invention will become obvious from the following detailed description.

SUMMARY OF THE INVENTION

The invention achieves the above objects by the fact that the front end of the pressure piston comprises in a transition region to the outer peripheral surface, a chamfer whose height is equal to or larger than a height of the annular enlargement.

This effectively prevents an adherence of the undesired particles to the outer peripheral surface of the pressure piston or, to put it differently, the cylindrical outer peripheral surface of the pressure piston no longer has contact with the undesired particles. At the same time, due to the relatively "high-rising" chamfer, more volume is available for the hydraulic medium. This necessarily means that more space is available for the undesired particles, so that their adherence to the outer peripheral surface of the pressure piston is precluded.

In a particularly advantageous embodiment of the invention, the chamfer has an angle $\alpha$ in the range of $30° \pm 15°$ relative to the outer peripheral surface of the pressure piston. It is obvious that an angle of 30° is preferred. This results in a particularly efficient wiping-off of the undesired particles.

If need be, it is possible according to an alternative solution offered by the invention, to configure the aforesaid region of the pressure piston substantially in the form of a smooth cylinder and to provide at least one oil wiper ring or the like on its outer peripheral surface. With this oil wiper ring, an ingress of the undesired particles into the leak gap is just as efficiently prevented. Where appropriate, the outer peripheral surface of the pressure piston itself or in combination with the surrounding bore of the housing, or this bore alone, can be configured similar to an oil wiper ring.

According to a further provision of the invention, the lash adjuster is installed or is installable in a cam follower of a valve train of an internal combustion engine, or it is a component of such a cam follower. The cam followers (switchable, non-switchable) in question may be, for instance, roller tappets, bucket tappets, rocker arms, oscillating arms or finger levers. The lash adjuster may further be used in support elements of finger levers.

According to a further proposition of the invention, the lash adjuster of the invention may be installed in a belt or chain tensioning device, for example, of a primary or secondary drive of an internal combustion engine. Generally speaking, however, it is conceivable to use the lash adjuster of the invention in any application in which it is necessary to adjust lash arising from thermal and/or wear conditions.

The invention will now be described more closely with reference to the appended drawing.

DETAILED DESCRIPTION OF THE DRAWING

Figure 1:
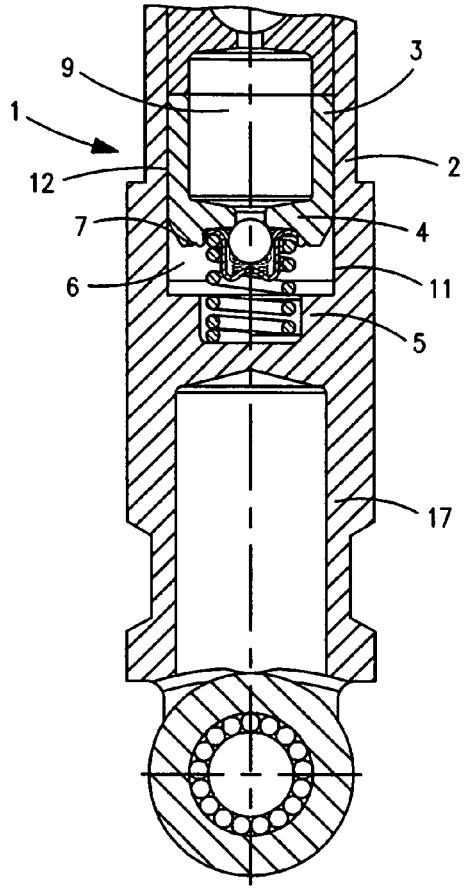
FIG. 1 shows a roller tappet comprising a hydraulic lash adjuster of the invention.

FIG. 1 discloses a cam follower 17 configured as a roller tappet of a valve train of an internal combustion engine. A lash adjuster 1 of the invention is installed in this cam follower 17. The lash adjuster 1 comprises, as can also be seen in FIG. 2, a hollow cylindrical housing 2 that is inter-inserted with an axially relatively displaceable pressure piston 3. In the embodiment of FIG. 1, the housing 2 is an integral part of an outer housing of the roller tappet 17.

Spaced from and opposing a front end 4 of the pressure piston 3 is situated a front end 5 of the housing 2. A high pressure chamber 6 for hydraulic medium is formed between the front ends 4, 5, more precisely, between a direct undersurface 7 of the front end 4 of the pressure piston 3 and a stop surface 13 of the front end 5 of the housing 2. The high pressure chamber 6 is supplied, as needed, with hydraulic medium through a one-way valve 8 from a reservoir 9 situated thereabove. The one-way valve 8 opens towards the high pressure chamber 6. The reservoir 9 is enclosed by the pressure piston 3.

A leak gap 12 for the hydraulic medium out of the high pressure chamber 6 is formed between an outer peripheral surface 10 of the pressure piston 3 and a bore 11 of the housing 2. As is sufficiently well-known in the art, during cam lift, a small quantity of hydraulic medium is pressed out of the high pressure chamber 6 through the leak gap 12 and is returned indirectly to the reservoir 9.

In the collapsed state of the pressure piston 3, the stop surface 13 of the front end 5 of the housing 2 forms a support for the undersurface 7 of the pressure piston 3 comprising the annular portion 14. If the internal combustion engine is shut off and the cam concerned is in a lift phase at this time, the quasi stiff connection established by the high pressure chamber 6 is gradually undone and the pressure piston 3 slips into the housing 2 till it comes to rest on the stop surface 13.

Fabrication-related primary dirt can accumulate in the bottom region of the bore 11 of the housing 2 i.e., on the stop surface 13. Under certain circumstances, other particles, too, like general impurities in the hydraulic medium, but also scuffing chips or the like, can likewise accumulate. In the prior art, upon a first adjusting movement of the pressure piston 3 out of the housing 2 after initial start-up of the engine, particles adhering to the outer peripheral surface 10 of the pressure piston 3 can be drawn into the leak gap 12. In the worst case, this can lead to a clamping of the pressure piston 3 in the housing 2, so that a proper lash adjusting function of the lash adjuster 1 is no longer possible.

Figure 2:
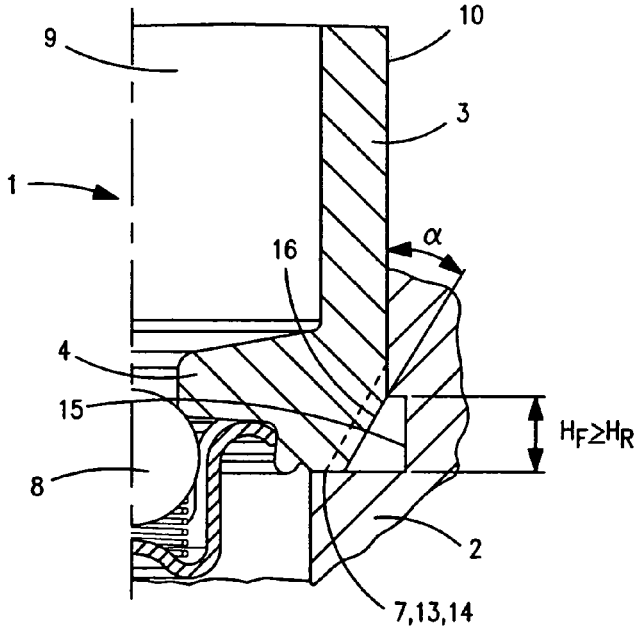
FIG. 2 is an enlarged representation of the lash adjuster of FIG. 1.

As best seen in FIG. 2, an annular enlargement 15 is arranged in the transition region from the bore 11 of the housing 2 to the stop surface 13. To prevent an adherence of the aforesaid particles to the outer peripheral surface 10 of the pressure piston 3, it is proposed to configure the front end 4 of the pressure piston 3 with a chamfer 16 whose height $H_F$ is equal to or larger than a height $H_R$ of the annular enlargement 15.

By virtue of this very simple measure, an adherence of the undesired particles to the outer peripheral surface 10 of the pressure piston 3 is prevented. Thus, these particles can no longer penetrate into the leak gap 12 with the aforesaid negative consequence.

To achieve a particularly good wiping-off of the adhering particles or the like, it is proposed to configure the chamfer 16 at an angle $\alpha$ in the range of 30°±15° to the outer peripheral surface 10 of the pressure piston 3.

It can be seen further in FIG. 2 that through the chamfer 16 configured in accordance with the invention, more volume is available in the high pressure chamber 6 when the pressure piston 3 is in contact with the stop surface 13 of the housing 2. Thus, to put it simply, more space is created in this region in which the undesired particles can disperse without adhering to the pressure piston 3.

LIST OF REFERENCE NUMERALS

1 Lash adjuster
2 Housing
3 Pressure piston
4 Front end of pressure piston
5 Front end of housing
6 High pressure chamber
7 Undersurface of pressure piston
8 One-way valve
9 Reservoir
10 Outer peripheral surface
11 Bore
12 Leak gap
13 Stop surface of housing
14 Annular region of pressure piston
15 Annular enlargement
16 Chamfer
17 Cam follower
$H_F$ Height of chamfer
$H_R$ Height of annular enlargement
$\alpha$ Angle of chamfer

The invention claimed is:

1. A hydraulic lash adjuster (1) comprising a hollow cylindrical housing (2) that is inter-inserted with an axially relatively displaceable pressure piston (3), wherein a high pressure chamber (6) for hydraulic medium extends between opposing front ends (4, 5) of the pressure piston (3) and the housing (2), which high pressure chamber (6) can be supplied, via a one-way valve (8) arranged on an undersurface (7) of the front end (4) of the pressure piston (3) and opening towards the high pressure chamber (6), with hydraulic medium out of a reservoir (9) enclosed by the pressure piston (3), a leak gap (12) for the hydraulic medium out of the high pressure chamber (6) is formed between an outer peripheral surface (10) of the pressure piston (3) and a bore (11) of the housing (2), the front end (5) of the housing (2) forms a stop surface (13) for an annular portion (14) of the front end (4) of the pressure piston (3) in a sunk state of the pressure piston (3), in a portion adjoining the front end (5) of the housing (2), the bore (11) of the housing (2) merges into an annular enlargement (15), wherein the front end (4) of the pressure piston (3) comprises in a transition region to the outer peripheral surface (10), a wiping chamfer (16) whose height ($H_F$) is larger than the height ($H_R$) of the annular enlargement (15) and the chamfer (16) has an angle ($\alpha$) in a range of 30°±15° relative to the outer peripheral surface (10) of the pressure piston (3) and the lash adjuster to provide additional volume in this space where undesired particles can be dispersed without adhering to the pressure piston (1) is installed in a cam follower (17) or in a support element of a cam follower of a valve train of an internal combustion engine, or is an integral part thereof.

2. A lash adjuster according to claim 1, wherein the lash adjuster (1) is installed in a tensioning device for a belt or a chain, or is an integral part thereof.

3. A hydraulic lash adjuster (1) comprising a hollow cylindrical housing (2) that is inter-inserted with an axially relatively displaceable pressure piston (3), wherein a high pressure chamber (6) for hydraulic medium extends between opposing front ends (4, 5) of the pressure piston (3) and the housing (2), which high pressure chamber (6) can be supplied, via a one-way valve (8) arranged on an undersurface (7) of the front end (4) of the pressure piston (3) and opening towards the high pressure chamber (6), with hydraulic medium out of a reservoir (9) enclosed by the pressure piston (3), a leak gap (12) for the hydraulic medium out of the high pressure chamber (6) is formed between an outer peripheral surface (10) of the pressure piston (3) end a bore (11) of the housing (2), the front end (5) of the housing (2) forms a stop surface (13) for an annular portion (14) of the front end (4) of the pressure piston (3) in a sunk state of the pressure piston (3), in a portion adjoining the front end (5) of the housing (2), the bore (11) of the housing (2) merges into an annular enlargement (15), wherein the front end (4) of the pressure piston (3) comprises in a transition region to the outer peripheral surface (10), a wiping chamfer (16) whose height ($H_F$) is larger than the height ($H_R$) of the annular enlargement (15) to provide additional volume in this space wherein undesired particles can be dispersed without adhering to the pressure piston wherein, in a transition region to the outer peripheral surface (10), the front end (4) of the pressure piston (3) comprises an oil wiper ring or is configured similar to an outer peripheral surface of an oil wiper ring.

* * * * *